United States Patent [19]

Kymmell et al.

[11] 4,176,538

[45] Dec. 4, 1979

[54] METHOD AND APPARATUS FOR THE FORMING OF METAL ENDLESS BELTS FROM BLANKS OF TUBULAR MATERIAL

[75] Inventors: Georg R. W. Kymmell, Waalre; Alexandre Horowitz, Eindhoven; Rudolf J. G. A. van der Hoorn, Nuenen, all of Netherlands

[73] Assignee: Volvo Car B.V., Eindhoven, Netherlands

[21] Appl. No.: 920,120

[22] Filed: Jun. 28, 1978

[30] Foreign Application Priority Data

Jun. 28, 1977 [NL] Netherlands ..... 7707172

[51] Int. Cl.[2] ..... B21B 5/00

[52] U.S. Cl. ..... 72/110; 72/111

[58] Field of Search ..... 72/110, 111, 205, 221, 72/183, 188; 74/231 M, 232, 233; 140/108

[56] References Cited

U.S. PATENT DOCUMENTS

| | | | |
|---|---|---|---|
| 1,221,029 | 4/1917 | Coryell | 72/111 |
| 2,920,494 | 1/1960 | Dodwell | 74/233 |

*Primary Examiner*—Lowell A. Larson

*Attorney, Agent, or Firm*—Haseltine, Lake & Waters

[57] ABSTRACT

The forming simultaneously of a series of cylindrical metal belts in a range of slightly different measures suitable to be fitted into each other into a multiple layer driving belt. The belts are formed from a series of blanks of tubular material, having the same diameter. Two parallel rotatable rolls, having a length exceeding the total length of the series of blanks are inserted through the series of blanks which are positioned side by side along the said length. One of the said inserted rolls is a stretch roll having a relatively small diameter with respect to a pair of work rolls of large diameter between which the tubing-stretch roll assembly is engaged in a position offset to one side of the plane containing the axes of the said work rolls. On the other side of the said plane the other of the said inserted rolls is urged in a direction away from the said plane as a tensioning roller, which has a step up range of slightly different diameters for areas along its length each engaging one of the said blanks.

7 Claims, 5 Drawing Figures

METHOD AND APPARATUS FOR THE FORMING OF METAL ENDLESS BELTS FROM BLANKS OF TUBULAR MATERIAL

BACKGROUND OF THE INVENTION

The invention relates to a process and equipment for the rolling of sections of preferably seamless metal tubing into thin, endless cylindrical belts. In the application of such belts as driving belts, especially for the transmission of great forces, for example in so called steplessly adjustable V-belt transmissions the driving belts are preferably formed as multiple layer belts by inserting a number of endless cylindrical belts of slightly different diameter one into the other. These belts should engage each other along their whole surface and therefore the outer diameter of each inserted belt should exactly correspond with the inner diameter of its adjoining outer belt. Until now it was difficult to manufacture a series of belts in a range of exact stop-up dimensions suitable for this purpose.

DESCRIPTION OF THE PRIOR ART

It is known from U.S. Pat. No. 3,507,135 to Natalis H. Polakowski to form thin endless metal belts from blanks of tubular material including inserting a pair of rolls of which at least one is a stretch roll of relatively small diameter through the interior of said tubing, engaging the tubing-stretch roll assembly between a pair of work rolls of large diameter in a position of the said stretch roll offset to one side of the plane containing the axes of the said work rolls and urging the other of the said inserted rolls on the opposite side of the said plane in a direction away from the said plane as a tensioning roller. This has been disclosed in the said Specification with reference to FIGS. 5 and 6 thereof.

This known art is applied in the present invention because it enables in a rather simple way to manufacture a thin belt predetermining the exactly dimensions thereof by the distance along which the tensioning roller is moved from the plane containing the axes of the main rollers.

SUMMARY OF THE INVENTION

It is an object of the present invention to obtain in a single operation a number of thin endless belts having diameters which are stepped with respect to each other suitable to be fitted within each other in a multiple layer driving belt wherein the outer diameter of each inserted elementary belt corresponds exactly with the inner diameter of an adjoining outer elementary belt.

Further objects are to provide for a simple control of the distance along which the tension roller is moved as a measuring means of the different predetermined diameters of the elementary belts which are simultaneously manufactured in a single apparatus, and to support the main rollers and the tension roll along their length as the invention desires a rather great length for these rolls and bending as a consequence of the forces exerted perpendicular to their axes would cause deviation from the desired belt dimensions.

Starting from the aforementioned state of art the invention and advantageous embodiments thereof are defined in the accompanying claims and described hereinafter with reference to the drawing representing some embodiments.

Figure 1:
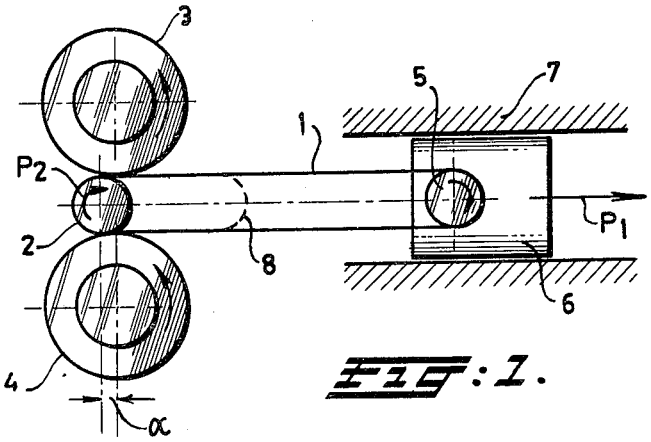
FIG. 1 is a schematic elevational end view including some parts shown in cross section of an apparatus for stretch rolling an endless metal band from a tubular blank as substantially known from the prior art.
Figure 2:
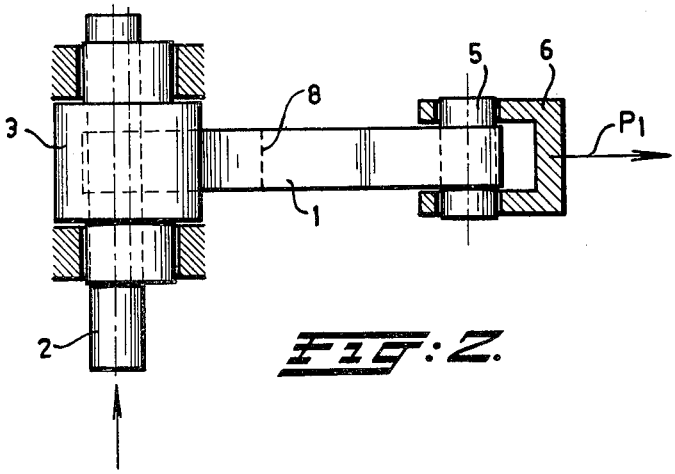
FIG. 2 shows in the same manner as FIG. 1 a top view on the arrangement of FIG. 1.
Figure 4:
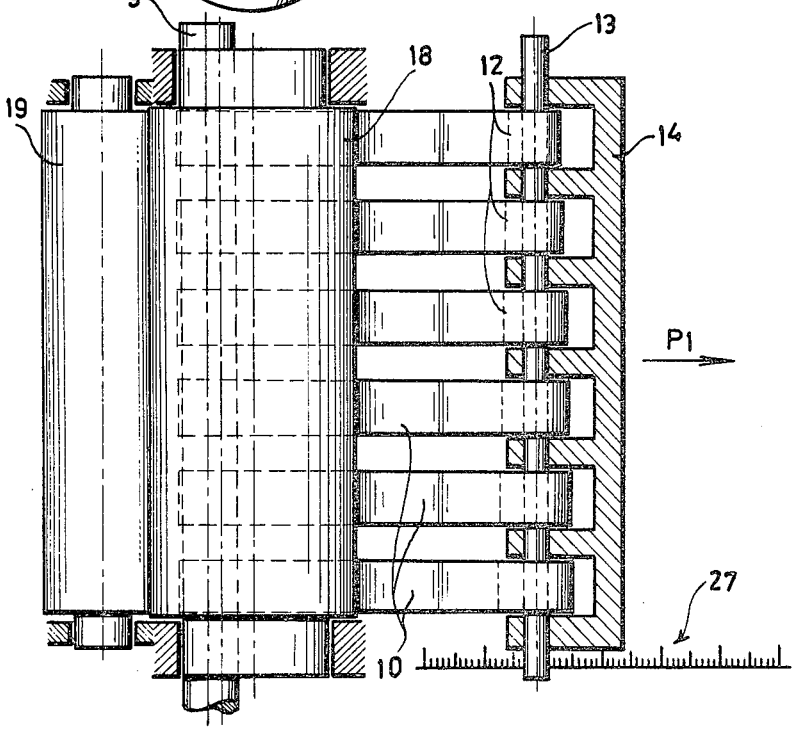
FIG. 4 is a top view of FIG. 3, shown in a similar manner as FIG. 2.

According to the prior art illustrated by FIGS. 1 and 2 an endless belt 1 is reduced in thickness on a stretch roll 2 which is in a position at a small distance a offset to one side of a plane containing the axes of two work rolls 3 and 4 and on the other side of said plane a tensioning roller 5 provided within the same endless belt 1 has its bearings in a slide block 6 which is guided rectilinearly and perpendicularly to the said plane in a guide track 7. The dotted line 8 indicates the original length of the cylindrical blank of tubular material which takes an oblong shape after insertion of the rolls 2 and 5 and pulling the roll 5 in the direction $P_1$. According to the present invention the guide track 7 is preferably provided with a scale graduation as schematically shown in FIG. 4 and denoted by 27, by which the distance along which the roll 5 is moved can exactly be read in order to control the predetermined length of the belt to be obtained from a circular cylindrical blank of a given wall thickness. Starting from blanks having a wall thickness of ½ mm an endless belt can be obtained in this way having e.g. a thickness of 1/10 mm and a predetermined length.

Figure 3:
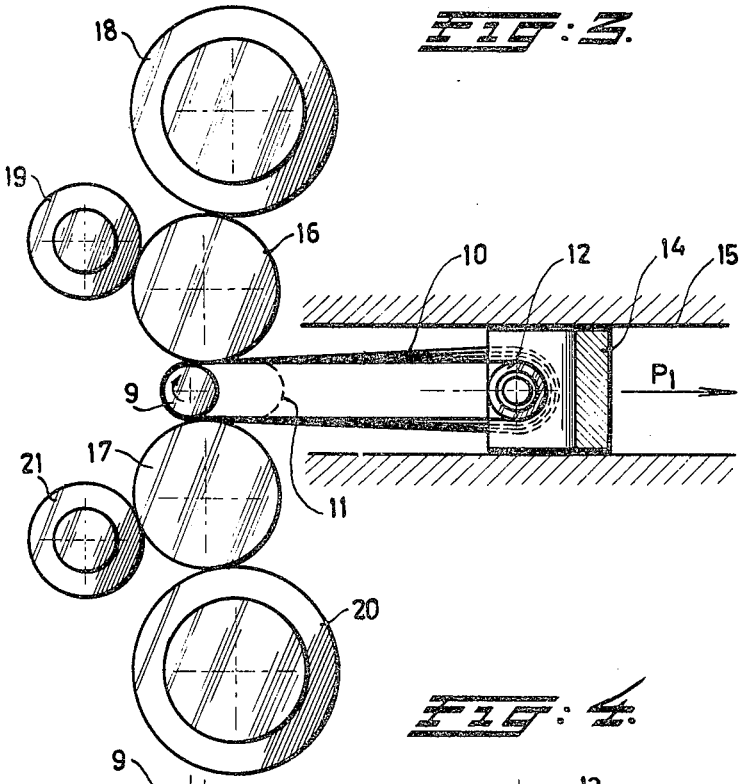
FIG. 3 shows in a similar view as that of FIG. 2 an embodiment of the present invention.

It is an object of the invention to obtain in one operation in a single apparatus simultaneously a set of belts having a step range of slightly different predetermined lengths suitable for the composition of a belt wherein said belt forms elementary belts or layers in a multiple layer belt wherein the diameter of each elementary inner belt corresponds exactly with the inner diameter of its adjoining surrounding outer elementary belt. As shown in FIGS. 3 and 4 for this purpose the rolls 9, 12, 13, 16 and 17 each have a length sufficient for the arrangement of a number of cylindrical blanks 11 to be spaced side by side around the rolls 9 and 12 along the length thereof. However, the tensioning roller 13 has a step up range 12 of slightly increasing diameters each for one area along the length of the roller 13, engaging one of the said blanks. The said areas are separated by bearings provided in wall portions of a comb shaped tensioning body 14. The said wall portions or comb teeth extend in the direction of the stretch roll 9. Thus elementary belts will be shaped having slightly different diameters as shown by dotted lines in FIG. 3 and together they form a set suitable to be composed into a multy layer belt as desired.

The step up range of diameters of the roll 13 may be obtained by means of the different diameters of separate bushings 12 rotatably mounted upon a fixed axis 13 and enclosed between the teeth of the cam body 14. In FIG. 4 each following bushing in the sequence of bushings in a downward direction in the figure has a slightly larger diameter than the preceeding bushing. The risk of bending of the rolls 16, 17 under influence of the forces exerted perpendicularly to their axes are large because a set of belts is rolled simultaneously in a single device and because the rolls must have a great length in order to arrange a number of side by side blanks, may be encoutered by designing these rolls with a large diameter. However, this would make the space between the rolls 16, 17 less accessable for the introduction of the stretch roll 9.

Figure 5:
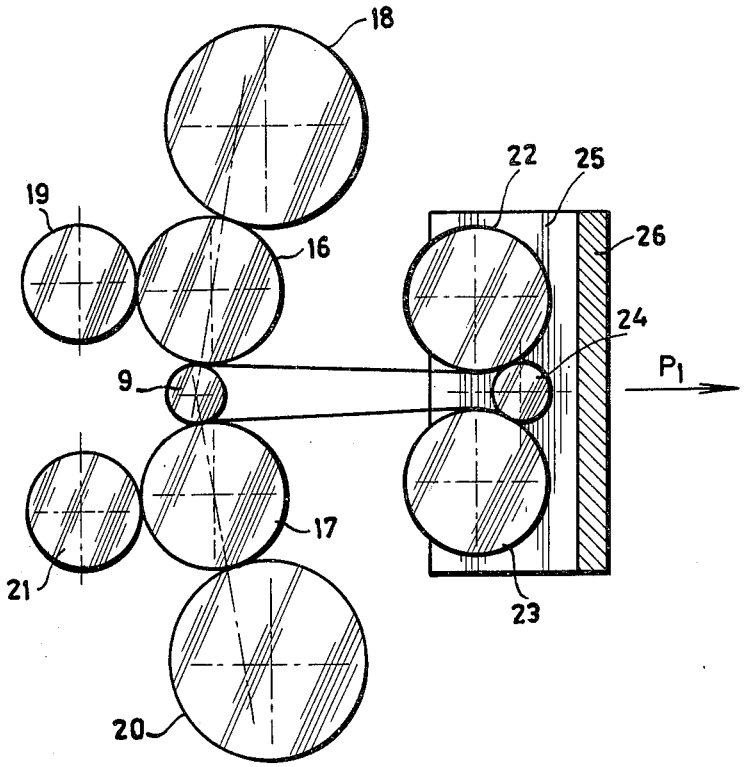
FIG. 5 is a schematic end view of another embodiment of the invention shown in a similar manner as in FIGS. 1 and 3.

Therefore as shown in FIG. 3, 4 and 5 according to an embodiment of the invention pairs of supporting rolls 18, 19 and 20, 21 are provided engaging the rolls 16, 17 respectively along their whole length. One roll 19, 20 respectively of each pair of supporting rolls engages its corresponding main roll surfaces 16, 17 respectively backward from the plane containing the axes of these main rolls and above respectively below the level of the corresponding main roll axis. The other one 18, 20 of each of said pairs of supporting rolls engages the surface of each corresponding main roll 16, 17 respectively at its upper respectively lower side slightly forward from the said plane in the direction of the tensioning roller 12, 13.

Instead of supporting the tensioning roller 13 along its length by the teeth walls of the comb shaped body 14 as shown in FIG. 4 this tension roller 14 may only be supported as shown in FIG. 5 at its outer ends rotatably in bearings provided in the legs 25 of a V-shaped tensioning block 26, supporting rollers 22 and 23 for the roll 24 bearing also at their outer ends in the said legs 25. This embodiment may be used for a tensioning roll 13 of the same character as that of FIGS. 3 and 4 having areas 12 of differing diameters in which case the supporting rolls 22, 23 have to be provided with grooves of different dephts corresponding with the said areas 12. However, the embodiment of FIG. 5 is also suitable for a tensioning roll 24 of continous diameter for stretch-rolling belts of large width.

It will be understood that the relation between the tensioning force $P_1$ and the thickness reduction forces exerted by the work rolls 16, 17 can be controlled by the setting of the distance between the axes of the said work rolls.

The lateral movement of the tensioning rolls 12, 13, 24 can have a constant velocity and at a given setting of the rolls 16, 17 the tensioning force is dependent on the said velocity of lateral movement of the tensioning rolls 12, 13, 24.

In an example of practical application of the invention the stretch roll 9 is the only one which is rotatably driven, the work rolls 16 and 17 as well as the rolls 12, 22, 23, 24 being driven by their contact with the belt or belts 10, and the supporting rolls 18, 19 and 20, 21 respectively by their engaging contacts with the rolls 16, 17 respectively. The roll 9 may have a diameter of 20 mm and be driven at a velocity of rotation of 200/m. The work rolls 3, 4 each may have a diameter of 100 mm and a distance between their axes of 117 mm, the distance between their surfaces being 17 mm in this case. The tensioning roll 13 or 24 may be moved under the circumstances of this example in the direction $P_1$ with a velocity of 6 mm/sec.

We claim:

1. A method for forming thin flat endless metal belts from blanks of tubular material by inserting a stretch roll and a tensioning roller of relatively small diameter in parallel to each other through the interior of a said blank, engaging the tubing-stretch roll assembly between a pair of work rolls of relatively large diameter keeping the tube wall under pressure of the said work rolls, while rolling in a position of the said stretch roll offset to one side of a plane containing the axes of the said work rolls, the said tensioning roller being urged at the same time on the other side of the said plane in a direction away from this plane, characterised in that the said stretch roll and the said tensioning roll are inserted through a series of blanks which are spaced side by side along the length of the said stretch and tensioning rolls, the said blanks engaging areas of at least one of the said rolls having a step up range of diameters differing from each other to such an extent that in a final position of the said tensioning roller parallel to the said stretch roll the endless cylindrical belts on the said rolls fit one into the other for the formation of a multiple layer belt wherein the outer diameter of each inserted belt corresponds exactly with the inner diameter of an adjoining outer belt.

2. A method for forming thin flat endless metal belts from blanks of tubular material by inserting a stretch roll and a tensioning roller of relatively small diameter in parallel to each other through the interior of a said blank, engaging the tubing-stretch roll assembly between a pair of work rolls of relatively large diameter keeping the tube wall under pressure of the said work rolls, while rolling in a position of the said stretch roll offset to one side of a plane containing the axes of the said work rolls, the said tensioning roller being urged at the same time on the other side of the said plane in a direction away from this plane, characterised in that of the said rolls the said stretch roll is the only one which is driven.

3. Apparatus for forming metal belts from tubular blanks comprising a pair of large diameter work rolls, means for mounting the said work rolls for rotational movement about parallel axes, a stretch roll insertable through a said tubular blank on one side of the said pair of work rolls, a tensioning roll insertable together with the said stretch roll through the same said blank but on the opposite side of the said stretch roll with respect to the said work rolls, means for displacement of the said tensioning roll in a direction away from the said work rolls pulling the assembly of the said stretch roll and the said blank in engagement with the surface of both said work rolls, characterised in that the length of the rolls allows the spaced side by side positioning of a plurality of said blanks along the said length, at least one of the said stretch and tensioning rolls having a step up range of diameters differing from each other, each along an area corresponding with the width of a said blank, the said diameter differences corresponding with differences of lengths between the formed metal belts in a predetermined end position of the said tensioning roller, wherein each of the shorter ones of the said formed belts when set in a circular cylindrical shape has an outer diameter corresponding with the inner diameter of a longer one in the range of the said formed belts.

4. An apparatus as claimed in claim 3 further characterised in that the said areas each corresponding with the width of a said blank are separated from each other by the teeth of a comb shaped body extending along the length of the said tensioning roller the comb teeth being provided with bearings for the said roller.

5. An apparatus as claimed in claim 3 further characterised in that the differing diameters in the said areas of the said tensioning roll are formed by means of bushings of different diameter rotatably mounted upon a cylindrical axis which is fixed in a pull block movably in a guide track substantially perpendicular to a line connecting the axes of the said work rolls.

6. An apparatus for forming metal belts form tubular blanks comprising a pair of large diameter work rolls, means mounting the said work rolls for rotational movement about parallel axes, a stretch roll insertable through a said tubular blank on one side of the said pair of work rolls, a tensioning roll insertable together with the said stretch roll through the same said blank but on the opposite side of the said stretch roll with respect to the said work rolls, means for displacement of the said tensioning roll in a direction away from the said work rolls pulling the assembly of the said stretch roll and the said blank in engagement with the surface of both said work rolls, characterised in that each of the said work rolls is engaged on its outer surface along its length by two supporting rollers one of each pair of said supporting rollers engaging the said surface on the same side as the said stretch roll but at a distance from the said stretch roll beyond the level of the axis of the said work roll the other one of each pair of the said supporting engaging the said work roll surface on the opposite side of a line between the axes of the said work rolls but at a short distance from the said line at the most outward side of the said work roll.

7. An apparatus as claimed in claim 3 further characterised in that the outer ends of the said tensioning roll as well as the outer ends of a pair of supporting rollers are rotatably mounted in bearings provided in legs of an V-shaped pull block, the axes of the said supporting rollers being positioned each on one side of the axis of the said tensioning roll in a common plane perpendicular to the guide track of the said pull block and offset in the direction of the work rolls with respect to the said tensioning roll axis.

* * * * *